United States Patent [19]

Janssen et al.

[11] Patent Number: 4,562,767

[45] Date of Patent: Jan. 7, 1986

[54] MUZZLE RECOIL DAMPENER

[75] Inventors: Karl-Egon Janssen, Meerbusch; Heinz G. Breuer, Duisburg, both of Fed. Rep. of Germany

[73] Assignee: Rheinmetall GmbH, Duesseldorf, Fed. Rep. of Germany

[21] Appl. No.: 459,689

[22] Filed: Jan. 20, 1983

[30] Foreign Application Priority Data

Feb. 4, 1982 [DE] Fed. Rep. of Germany ..... 3203807

[51] Int. Cl.[4] ..... F41C 21/18

[52] U.S. Cl. ..... 89/14.3

[58] Field of Search ..... 89/14 C, 14 D

[56] References Cited

U.S. PATENT DOCUMENTS

| | | | |
|---|---|---|---|
| 1,390,658 | 9/1921 | Towson | 89/14 C |
| 1,636,357 | 7/1927 | Cutts | 89/14 C |
| 2,852,983 | 9/1958 | Netzer | 89/14 |
| 3,115,060 | 12/1963 | Ashbrook et al. | 89/14 |
| 3,141,376 | 7/1964 | Chinn | 89/14 |
| 3,367,055 | 2/1968 | Powell | 89/14 C |
| 3,858,481 | 1/1975 | Elliott | 89/14 C |

FOREIGN PATENT DOCUMENTS

| | | |
|---|---|---|
| 169838 | 4/1904 | Fed. Rep. of Germany . |
| 125141 | 4/1919 | United Kingdom . |

OTHER PUBLICATIONS

"Bedeutung und Wirkungsprinzip von Mündungsbremsen", *Militärtechnik*, Jun. 1974, pp. 248–251.

*Primary Examiner*—Charles T. Jordan
*Assistant Examiner*—Ted L. Parr

[57] ABSTRACT

A muzzle dampening or brake device adapted to be coaxially mounted on the muzzle end of a gun barrel. The inner diameter of the device corresponds to that of the gun barrel. The device has a pair of diametrically opposite gas exit openings. The device has a plurality of equiangularly spaced bores disposed in parallel uniformly spaced planes which place the interior of the device in communication with the exterior. The bores in each plane are angularly offset with respect to the bores of the next adjoining plane. Annular grooves are disposed on the exterior periphery of the device and are in communication with the bores to thereby permit the exiting of the smoke gases at firing and a better distribution thereof so as to minimize the blocking or lowering of visibility of the personnel servicing the gun.

7 Claims, 5 Drawing Figures

FIG. 1
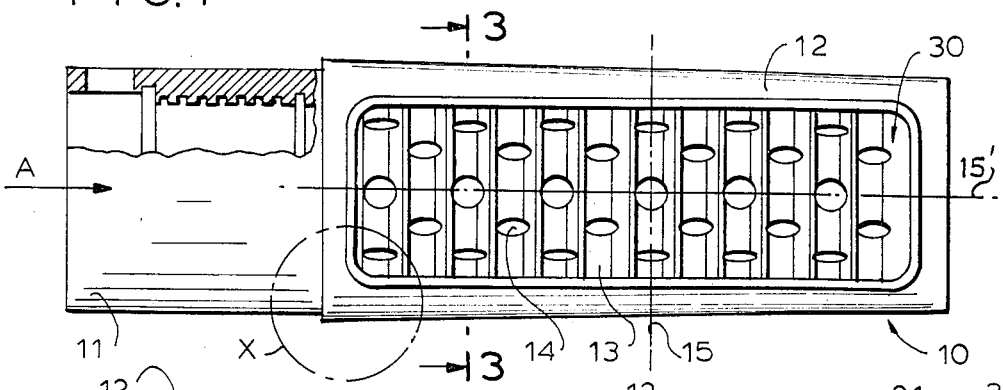
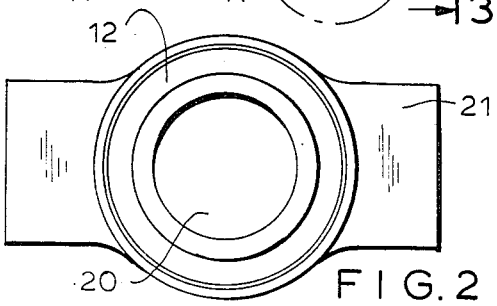
FIG. 2
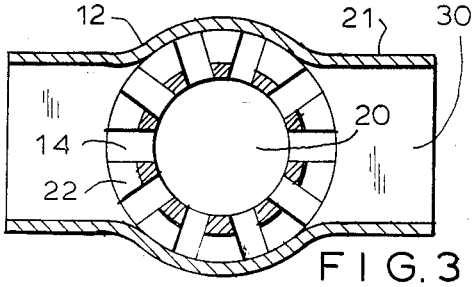
FIG. 3
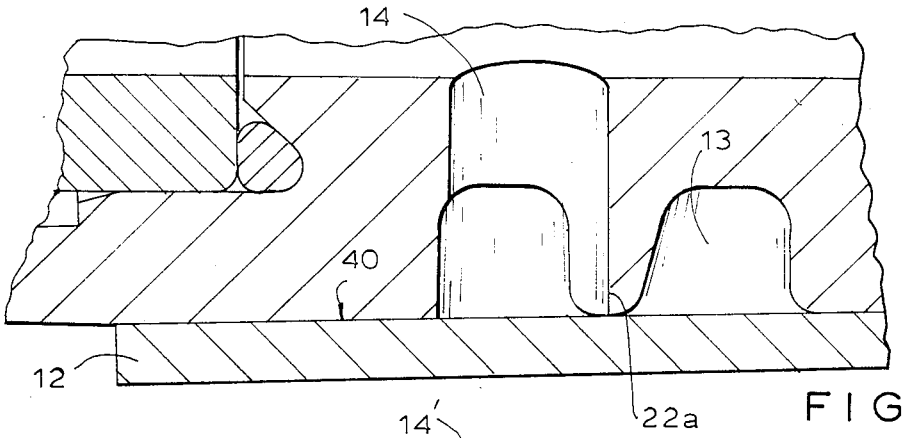
FIG. 4
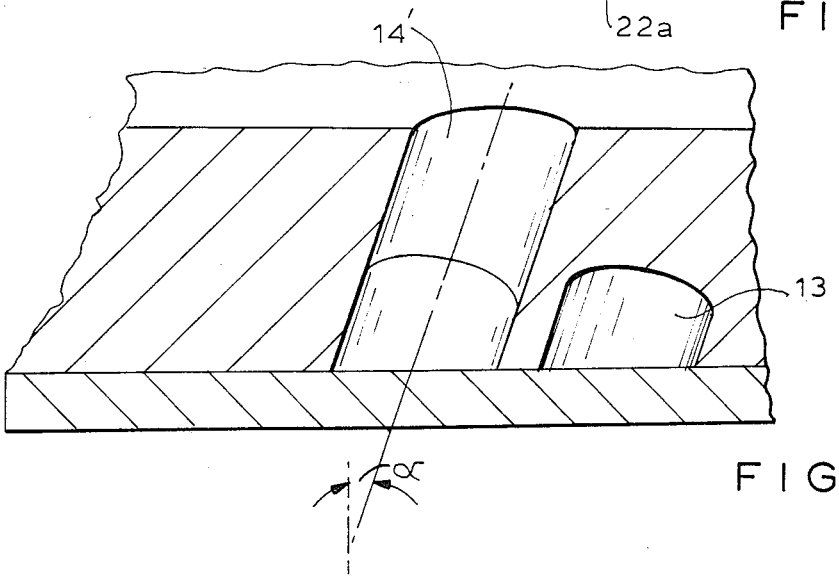
FIG. 5

MUZZLE RECOIL DAMPENER

BACKGROUND OF THE INVENTION

The invention relates to a muzzle dampening or brake device for a gun barrel which includes a pipe member coaxially disposed on the muzzle of the gun barrel, which pipe member has diametrically oppositely disposed transverse bores which are substantially normal to the longitudinal axis of the gun barrel.

Such a muzzle dampening device is described in the publication "MILITAERTECHNIK 6/1974, page 250".

As is well known, the effect of a muzzle brake or dampening device resides in that the recoil, which occurs immediately after the firing of a projectile out of the muzzle accompanied with the exiting propellant charge gases from the muzzle, is reduced. This makes it possible to obtain a variety of advantages. For example, the magnitude of the effective recoil energy and the recoil travel of the gun barrel can be reduced, whereby, for example, concomitantly the firing velocity can be increased. The gas exit openings which form part of the muzzle dampening device are disposed in a plane diametrically opposite each other which plane is parallel to the ground surface, whereby there can be prevented that the gases which exit after firing and impinge on the ground surface do not create dust clouds which disturb the aiming of the gun barrel. Moreover, the muzzle dampening device can advantageously influence the smoke distribution of the powder gases which exit from the muzzle.

SUMMARY OF THE INVENTION

It is an object of this invention to provide a new type of muzzle dampening or brake device which is particularly suitable for large caliber weapons.

It is another object of this invention to provide such a muzzle dampening or brake device which is simple to manufacture and which is particularly suitable for firing projectiles having sabots.

A further object of the new type of muzzle brake or dampening device resides in improving the smoke distribution in order to prevent a disadvantageous influence on the aiming and firing means used in conjunction with the weapon.

BRIEF DESCRIPTION OF THE DRAWING

With these and other objects in view, which will become apparent in the following detailed description, the present invention, which is shown by example only, will be clearly understood in connection with the accompanying drawing, in which:

FIG. 1 is a side-elevational view (partially in cross-section) of the muzzle dampening or brake device of this invention;

FIG. 2 is an end-elevational view of the muzzle brake or dampening device viewed in the direction of the arrow A in FIG. 1;

FIG. 3 is a cross-sectional view along line 3—3 of FIG. 1;

FIG. 4 is a view of a detail of the muzzle brake or dampening device of the invention in the region marked with the circle X in FIG. 1, which detail is illustrated at an enlarged scale; and FIG. 5 is an enlarged detailed view of a further embodiment of the invention having bores that are angularly disposed with respect to the longitudinal axis of the gun barrel.

DETAILED DESCRIPTION

FIG. 1 illustrates partially in cross-section the side-elevational view of the muzzle brake or dampening device 10 which comprises a pipe member 22 (FIG. 3), the inner diameter of which corresponds to that of the caliber of the gun barrel. In the pipe member 22 there are provided a plurality of bores 14 which are arranged in a plurality of transverse planes 15, which are disposed parallelly one behind the other and normal to the longitudinal axis of the gun barrel. The bores 14 are uniformly angularly spaced from each other in each plane 15 about the periphery of the pipe member 22 and extend preferably in a radial direction. By making the inner diameter of the pipe member 22 of the same caliber as that of the gun barrel there is insured that at firing of projectiles having sabots, the latter can only separate from the projectile proper after the exiting of the projectile assembly from the muzzle of the muzzle brake or dampening device.

In a further embodiment of the invention (FIG. 5) the bores 14' are disposed at an angle $\alpha$ in the pipe member 22 with respect to the longitudinal axis of the gun barrel in a plurality of conical coaxial planes, disposed one behind the other.

The bores 14, respectively 14', are angularly mutually offset in adjoining planes 15, respectively adjoining conical surfaces, in such a way that they are mutually "spaced" from each other. Thereby there is attained that a uniform distribution on the inner peripheral surface of the muzzle brake or dampening device between the cross-sectional areas of the bores 14, 14' and the inner peripheral surface of the muzzle brake or dampening device is achieved. The ratio between the area occupied by the bores relative to the complete inner peripheral surface area should advantageously not be more than 0.5. In this manner the useful life of the muzzle brake or dampening device is increased in view of the fact that a very uniform wear occurs. The cross-sectional areas of the bores 14, 14' are preferably circular. However, other shapes of cross-sectional areas are also possible but are more difficult to manufacture. In the exterior peripheral surface 40 of the pipe 22 there are disposed a plurality of annular grooves 13 coplanar with respect to the planes 15, which are in communication with the bores 14 also disposed in the planes 15. In the embodiment of the invention, in which the bores 14' are disposed at an angle $\alpha$ with respect to planes that are normal to the longitudinal axis of the gun barrel; the grooves 13 are disposed in a plurality of planes which are uniformly spaced, parallel to each other, and normal to the longitudinal axis of the gun barrel, in such way that here too they are in communication with the outlet openings of the bores 14'. The annular grooves 13 form around the pipe 22 channels which are in communication with the bores 14, respectively 14' so that the smoking gases can exit from the interior of the gun barrel in a very effective manner.

In a further embodiment of the invention the groove 13 may also be spiral or helical, which groove winds helically about the gun barrel 22 of the muzzle brake or dampening device 10 and is in communication with all outlet openings of all bores 14, 14' thereby joining them to each other.

The pipe 22 of the muzzle brake or dampening device 10 is surrounded by a coaxial housing 12, which is gas-tightly mounted on the cross pieces disposed between the grooves 13. This housing is provided with two transverse diametrically opposite extensions 21 which form exit openings 30. These exit openings are disposed in a known manner in a plane parallel to the ground surface to insure that the exiting gas can only exit in a lateral direction and cannot produce a whirling or turbulent stream of dust or gas clouds which detract or block completely the aim of the personnel servicing the weapon.

The muzzle brake or dampening device 10 of the invention is advantageously threadably mounted on the gun barrel. In this manner it can be easily dismounted and, in case of need, exchanged with another muzzle brake or dampening device without requiring a complete exchange of the gun barrel.

By means of the novel arrangement of the bores 14, 14' and the annular grooves 13 there is attained a particularly favorable effect for the muzzle brake or dampening device. The smoke gases that occur at firing are effectively drawn off, which has a consequence, that the unavoidable blocking or lowering of visibility that occurs due the emission of the smoke gases from the muzzle is relatively short compared to the muzzle brakes or dampening devices of the state of the art. This is particularly advantageous because it makes it possible to follow the path of the projectile and its target impacting by means of optical devices during the firing of a projectile. Furthermore it makes possible to increase the firing cadence without detracting from the target impact precision due to lack of possibility to observe the trajectory of the projectile and the hitting of the target as a result of the inhibition of visibility due to smoke production.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. In a gun barrel, an improved muzzle dampening or brake device having a housing with a pair of diametrically opposite gas emission outlets mounted thereon which outlets extend substantially normally to the longitudinal axis of the gun barrel, said device is adapted to be coaxially mounted on the muzzle end of a gun barrel, the improvement comprising:

(a) the interior diameter of said muzzle dampening or brake device is identical to the caliber of the gun barrel;

(b) said device having a plurality of through-bores for placing the interior of the device in communication with the ambient atmosphere, the through-bores are equiangularly disposed about the axis of the device in a plurality of parallel planes which are normal with respect to the longitudinal axis of the gun barrel;

(c) a plurality of annular parallel grooves disposed on the outer periphery of the device normally with respect to the axis of the device, each of said grooves being in communication with the through-bores disposed in one of said parallel planes;

(d) said device is of cylindrical shape, said housing being coaxially gas-tightly mounted over said device, said housing having a pair of diametrically opposite horizontally projecting extensions defining said pair of opposite gas emission outlets which are in fluid communication with said plurality of annular grooves; said housing having a sufficient axial length so as to cover all of said annular parallel grooves.

2. The improved muzzle dampening or brake device as defined in claim 1, wherein said through-bores extend radially with respect to the axis of the device.

3. The improved muzzle dampening or brake device as defined in claim 2, wherein said equiangularly disposed through-bores in each plane are angularly offset with respect to the through-bores in the next adjoining plane relative to the axis of the device.

4. The improved muzzle dampening or brake device as defined in claim 3, including a helical groove disposed on the outer periphery of the device and being in communication with said plurality of through-bores disposed in a plurality of parallel conical planes.

5. The improved muzzle dampening or brake device as defined in claim 1, wherein said through-bores have circular cross-sections.

6. The improved muzzle dampening or brake device as defined in claim 5, wherein the ratio of the total cross-sectional areas of the inlets of said plurality of through-bores inside said device to the total interior peripheral surface of said device is less than about 0.5.

7. The improved muzzle dampening or brake device as defined in claim 6, wherein said device is threadably mounted on the muzzle end of the gun barrel.

* * * * *